US006174136B1

(12) United States Patent
Kilayko et al.

(10) Patent No.: US 6,174,136 B1
(45) Date of Patent: Jan. 16, 2001

(54) PUMP CONTROL AND METHOD OF OPERATING SAME

(75) Inventors: Enrique L. Kilayko, Spruce Head, ME (US); Liam Ryan, Limerick (IE)

(73) Assignee: Liquid Metronics Incorporated, Acton, MA (US)

( * ) Notice: Under 35 U.S.C. 154(b), the term of this patent shall be extended for 0 days.

(21) Appl. No.: 09/170,438

(22) Filed: Oct. 13, 1998

(51) Int. Cl.[7] ..... F04B 49/06

(52) U.S. Cl. ..... 417/44.1

(58) Field of Search ..... 417/44.1, 44.2, 417/45, 212, 413.1

(56) References Cited

U.S. PATENT DOCUMENTS

| | | | | |
|---|---|---|---|---|
| 3,602,246 | | 8/1971 | Hettinger et al. | 137/270 |
| 3,715,174 | | 2/1973 | Davis et al. | 417/311 |
| 3,723,840 | | 3/1973 | Opal et al. | 318/432 |
| 3,855,515 | | 12/1974 | Hutchins, Jr. | 318/685 |
| 3,984,315 | | 10/1976 | Ernst et al. | 210/31 C |
| 4,147,824 | | 4/1979 | Dettmann et al. | 428/65 |
| 4,195,662 | | 4/1980 | Gottel | 137/554 |
| 4,285,497 | | 8/1981 | Guttel | 251/138 |
| 4,291,358 | | 9/1981 | Dettmann et al. | 361/154 |
| 4,473,338 | | 9/1984 | Garmong | 417/12 |
| 4,523,902 | * | 6/1985 | Wally | 417/413.1 |
| 4,534,539 | | 8/1985 | Dettmann | 251/65 |
| 4,578,626 | | 3/1986 | Richter | 318/338 |
| 4,661,751 | | 4/1987 | Werner | 318/332 |
| 4,718,824 | | 1/1988 | Cholet et al. | 417/14 |
| 4,811,624 | | 3/1989 | Fritsch | 74/571 L |
| 4,839,571 | * | 6/1989 | Farnham et al. | 340/606 |
| 4,841,404 | | 6/1989 | Marshall et al. | 361/30 |
| 4,966,528 | | 10/1990 | Henkel et al. | 417/63 |
| 4,994,984 | * | 2/1991 | Massimo | 364/510 |
| 5,013,990 | | 5/1991 | Weber | 318/814 |
| 5,015,153 | | 5/1991 | Uesugi et al. | 417/44 |
| 5,040,567 | | 8/1991 | Nestler et al. | 137/625.44 |
| 5,054,522 | | 10/1991 | Kowanz et al. | 137/625.33 |
| 5,056,036 | | 10/1991 | VanBork | 364/510 |
| 5,096,643 | | 3/1992 | Kowanz et al. | 264/130 |
| 5,120,199 | * | 6/1992 | Youngs et al. | 417/18 |
| 5,141,402 | | 8/1992 | Bloomquist et al. | 417/5 |
| 5,204,595 | | 4/1993 | Opal et al. | 318/430 |
| 5,249,932 | | 10/1993 | Van Bork . | |
| 5,260,175 | | 11/1993 | Kowanz et al. | 430/326 |
| 5,269,659 | | 12/1993 | Hampton et al. | 417/12 |
| 5,372,482 | | 12/1994 | London et al. | 417/12 |
| 5,543,108 | | 8/1996 | Bacher et al. | 264/553 |
| 5,545,012 | | 8/1996 | Anastos et al. | 417/44.11 |
| 5,549,456 | | 8/1996 | Burrill et al. | 417/12 |
| 5,551,664 | | 9/1996 | Boke | 251/30.03 |
| 5,641,270 | | 6/1997 | Sagourakes et al. . | |
| 5,650,709 | | 7/1997 | Rotunda et al. | 318/802 |

(List continued on next page.)

FOREIGN PATENT DOCUMENTS

| | | |
|---|---|---|
| 42 30 662 | 9/1991 | (DE) . |
| 0 294 858 | 12/1988 | (EP) . |
| 0 483 447 | 5/1992 | (EP) . |
| 1 567 041 | 5/1980 | (GB) . |
| 2108212 | 5/1983 | (GB) . |

OTHER PUBLICATIONS

International Search Report, PCT/US99/23136, May 24, 2000.

Product Brochure "Metering Pumps", LMI Milton Roy, Jun. 1998.

Product Brochure "Metering Pumps and Accessories" created in Oct. 1992 for Liquid Metronics Division of Milton Roy.

*Primary Examiner*—Teresa Walberg
*Assistant Examiner*—Vinod D Patel
(74) *Attorney, Agent, or Firm*—Marshall, O'Toole, Gerstein, Murray & Borun

(57) ABSTRACT

A control for a pump detects an operational characteristic thereof and controls movement of a pump element based on the detected operational characteristic.

20 Claims, 15 Drawing Sheets

U.S. PATENT DOCUMENTS

| | | | |
|---|---|---|---|
| 5,653,422 | 8/1997 | Pieloth et al. | 251/129.2 |
| 5,711,346 | 1/1998 | Pieloth et al. | 137/625.44 |
| 5,718,567 | 2/1998 | Rapp et al. | 417/395 |
| 5,746,079 | 5/1998 | Hettinger et al. | 72/57 |
| 5,762,097 | 6/1998 | Hettinger et al. | 137/270 |
| 5,779,218 | 7/1998 | Kowanz | 251/129.06 |

* cited by examiner

PUMP CONTROL AND METHOD OF OPERATING SAME

TECHNICAL FIELD

The present invention relates generally to pumps, and more particularly to a method and apparatus for controlling a pump.

BACKGROUND OF THE INVENTION

Often, it is necessary in an industrial or other process to inject a measured quantity of a flowable material into a further stream of material or a vessel. Metering pumps have been developed for this purpose and may be either electrically or hydraulically actuated. Conventionally, an electromagnetic metering pump utilizes a linear solenoid which is provided half-wave or full-wave rectified pulses to move a diaphragm mechanically linked to an armature of the solenoid. FIGS. 1 and 2 illustrate a conventional control strategy for an electromagnetic metering pump pumping against ten bar and five bar force levels, respectively. In the conventional electromagnetic metering pump, the solenoid is electrically powered at a sufficient level to provide a pumping force at maximum air gap (i.e., zero stroke) which will meet or exceed the maximum pumping force expected to be encountered. The electric power is also delivered at maximum power level at all other stroke positions, resulting in a wasting of force and energy and development of heat. The heat that is generated typically results in the need for components that can tolerate same, such as metal enclosures and other metal parts and/or larger solenoids with more copper windings. In addition, the extra forces applied to the armature result in the need for relatively heaver return springs and components to counteract residual magnetism and allow the armature to return in time for the pump diaphragm to do suction work. Still further, sound levels are increased owing to the banging of the armature at the end of the stroke when pumping against lower force levels, and further due to the striking of the armature against a stroke adjustment stop at the end of each suction stroke under the influence of the heavy return spring. Service life is typically short owing to the mechanical stresses that are encountered.

In an effort to overcome these problems, a different control methodology has been implemented which has been graphically illustrated in FIGS. 3 and 4. In FIG. 3, the solenoid is energized by a pulse train consisting of full-wave rectified sine waves followed by half waves. This control methodology allows the pump to be more efficient, thereby permitting larger capacity models to be completely housed in corrosion resistant plastic owing to the lower levels of heat that are produced. FIG. 4 illustrates yet another modification wherein the ratio of half-wave to full-wave pulses is adjustable so that a user can reduce power if lower pressures are encountered. One can see by an inspection of FIGS. 3 and 4 that wasted force and energy (and thus heat) are reduced as compared with the conventional technology illustrated in FIGS. 1 and 2. However, even with these significant advancements in control methodology, it would be desirable to further reduce the wasting of force and energy in the operation of the pump.

SUMMARY OF THE INVENTION

In accordance with the present invention, a control for a pump and a method of operating same results in a substantial reduction in the amount of wasted force and energy as well as a substantial reduction in the amount of heat produced thereby.

More particularly, in accordance with one aspect of the present invention, a control for a pump having a movable pump element includes a sensor for detecting an operational characteristic of the pump and means responsive to the sensor for controlling movement of the pump element based on the detected operational characteristic.

Preferably, the sensor comprises a position sensor which senses pump element position. Also preferably, the pump element comprises a coil and an armature. The controlling means may include means for modulating electrical power delivered to the coil. In addition, the modulating means may be responsive to pump element velocity.

In accordance with another embodiment, the sensor comprises at least one pressure transducer which senses a pressure differential.

In alternative embodiments, the pump may comprise an electromagnetic metering pump, a lost motion hydraulic metering pump or a variable amplitude hydraulic metering pump.

In accordance with a further aspect of the present invention, a control for an electromagnetic metering pump having a coil, a movable armature and a diaphragm coupled to the movable armature comprises a sensor for detecting an operational characteristic of the metering pump and a driver circuit coupled to the coil and supplying electrical power thereto. Means are coupled between the sensor and the driver circuit for controlling the driver circuit such that electrical power is delivered to the coil in dependance upon a load exposed to the diaphragm.

In accordance with yet another aspect of the present invention, a control for an electromagnetic metering pump having a coil, a movable armature and a diaphragm coupled to the movable armature includes a sensor for detecting armature position and a driver circuit coupled to the coil and delivering electrical power thereto. A programmed processor is responsive to the sensor for controlling the driver circuit such that electrical power is delivered to the coil in dependence upon the position of the armature.

In accordance with yet another aspect of the present invention, a method of controlling of pump having a coil, an armature movable within a range of positions and a pumping element coupled to the armature comprises the steps of detecting the position of the armature and providing electric power to the coil based on the position of the armature.

DESCRIPTION OF THE PREFERRED EMBODIMENTS

Figure 1:
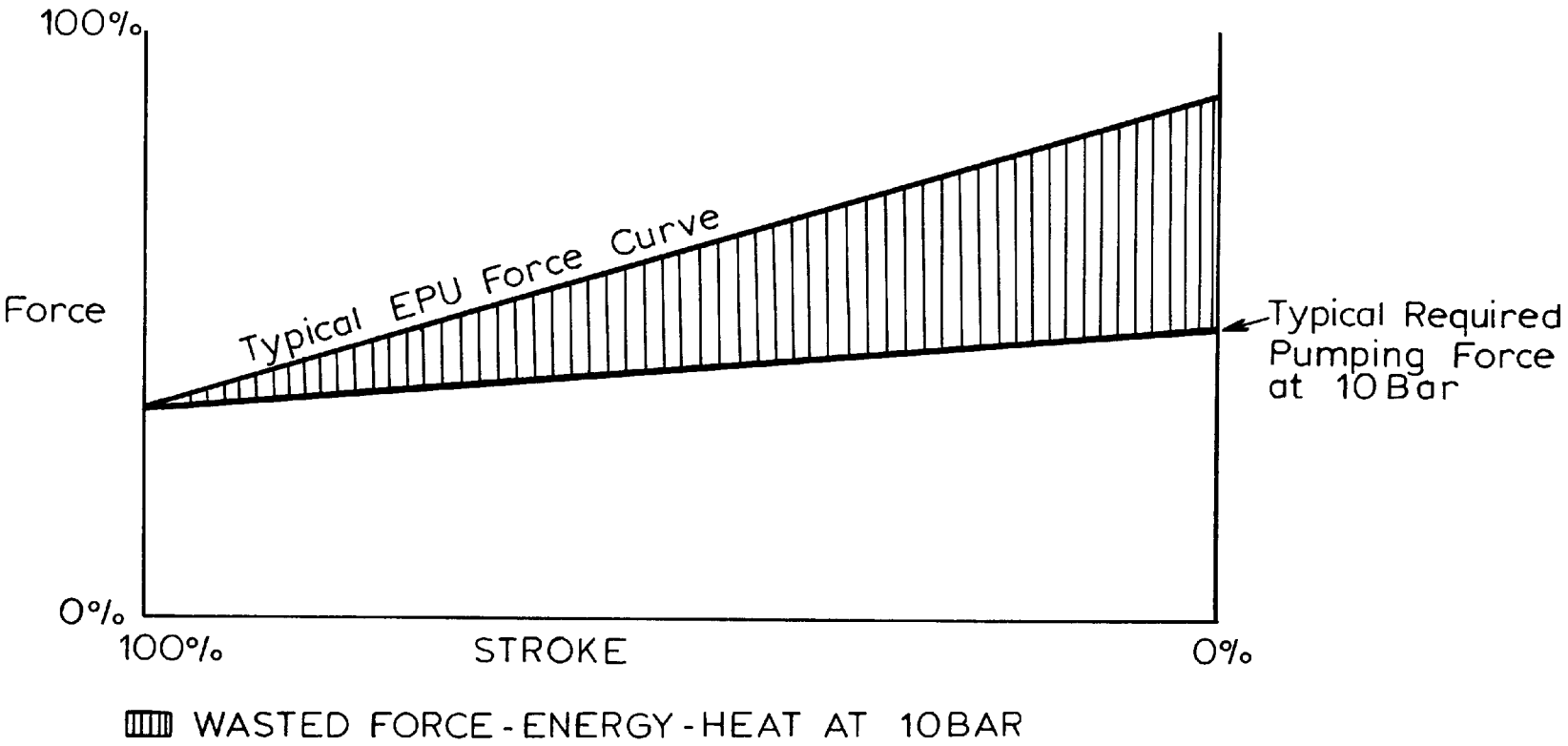
FIG. 1 PRIOR ART
FIGS. 1–4 are idealized graphs illustrating developed armature force as a function of armature position for prior art electromagnetic metering pumps.
Figure 2:
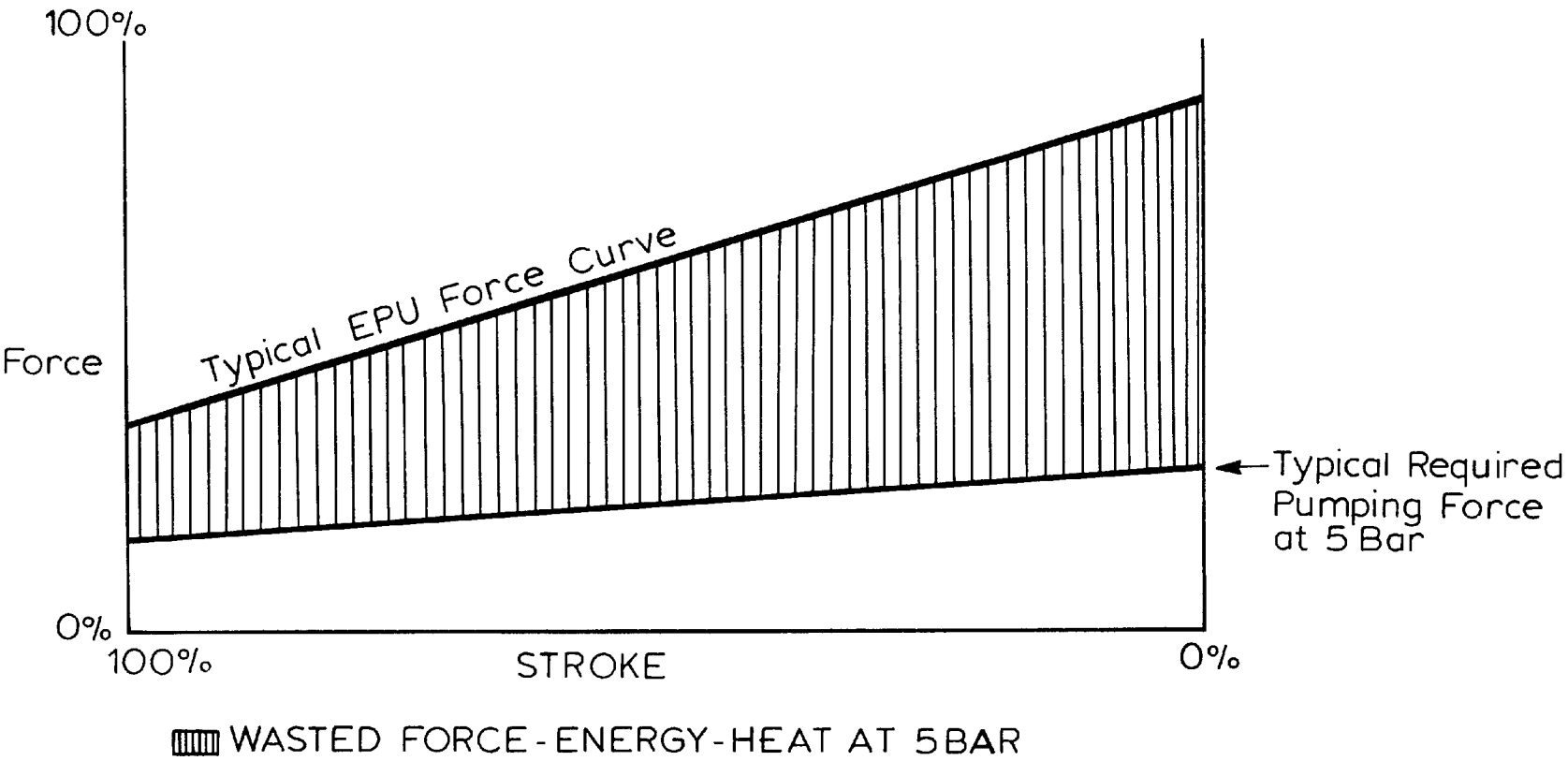
FIG. 2 PRIOR ART
Figure 3:
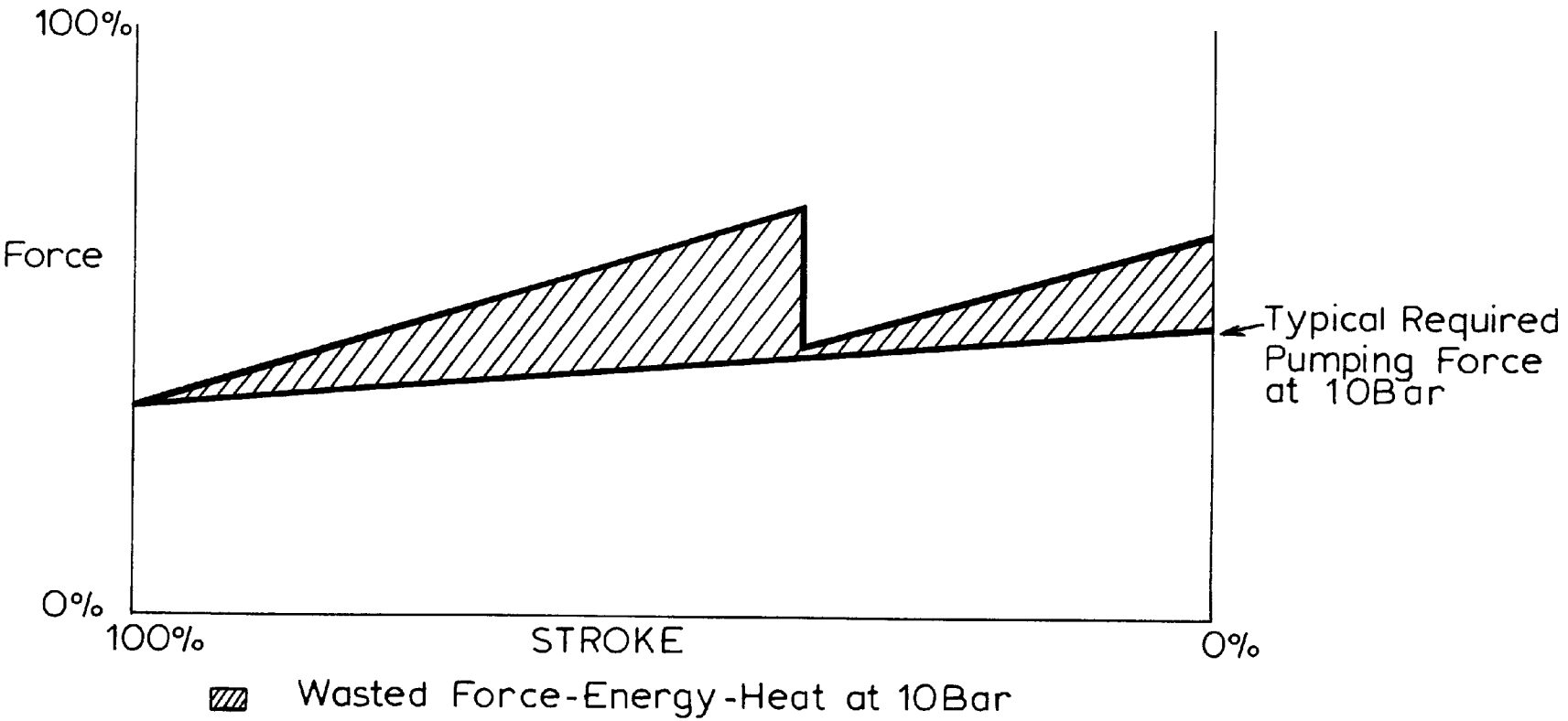
FIG. 3 PRIOR ART
Figure 4:
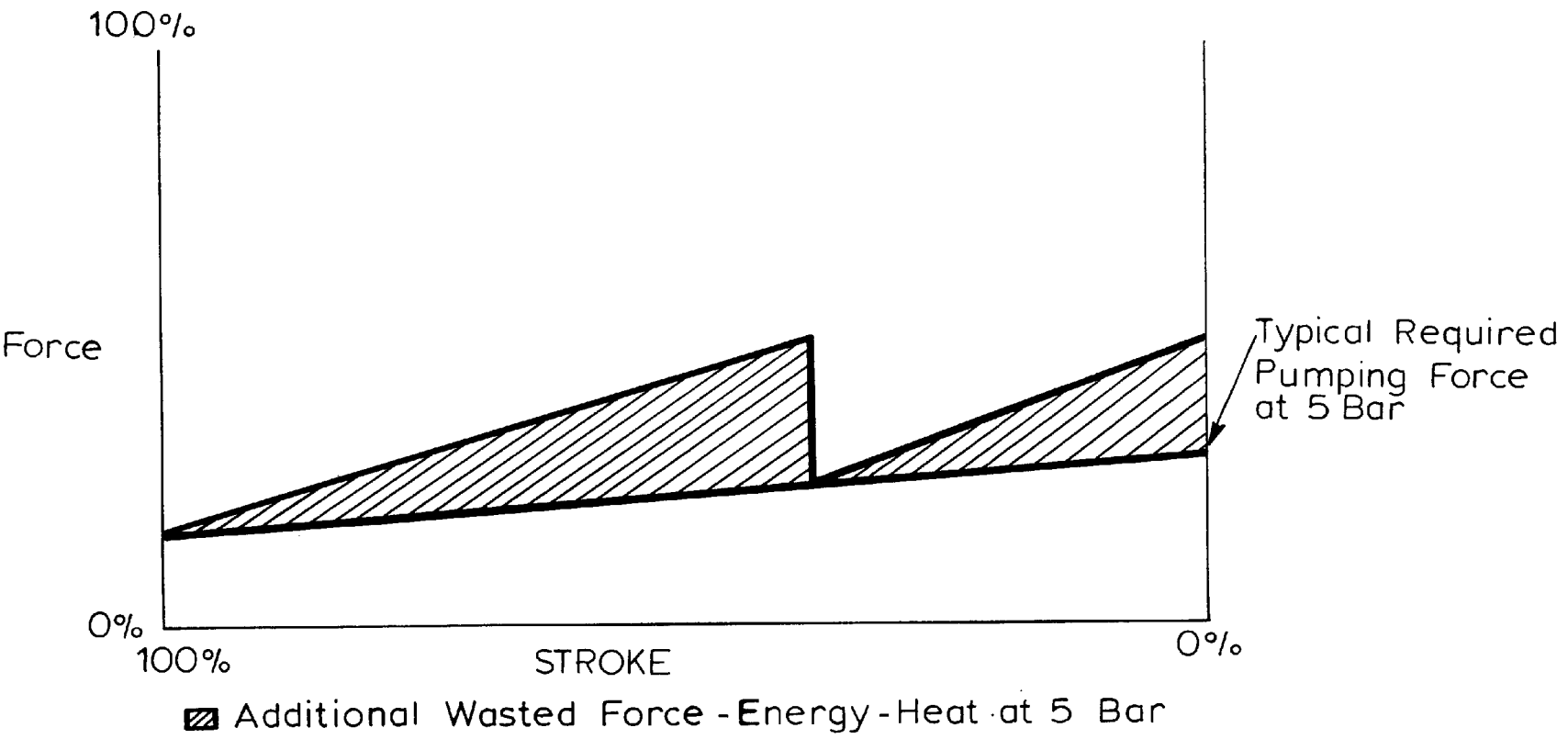
FIG. 4 PRIOR ART
Figure 5:
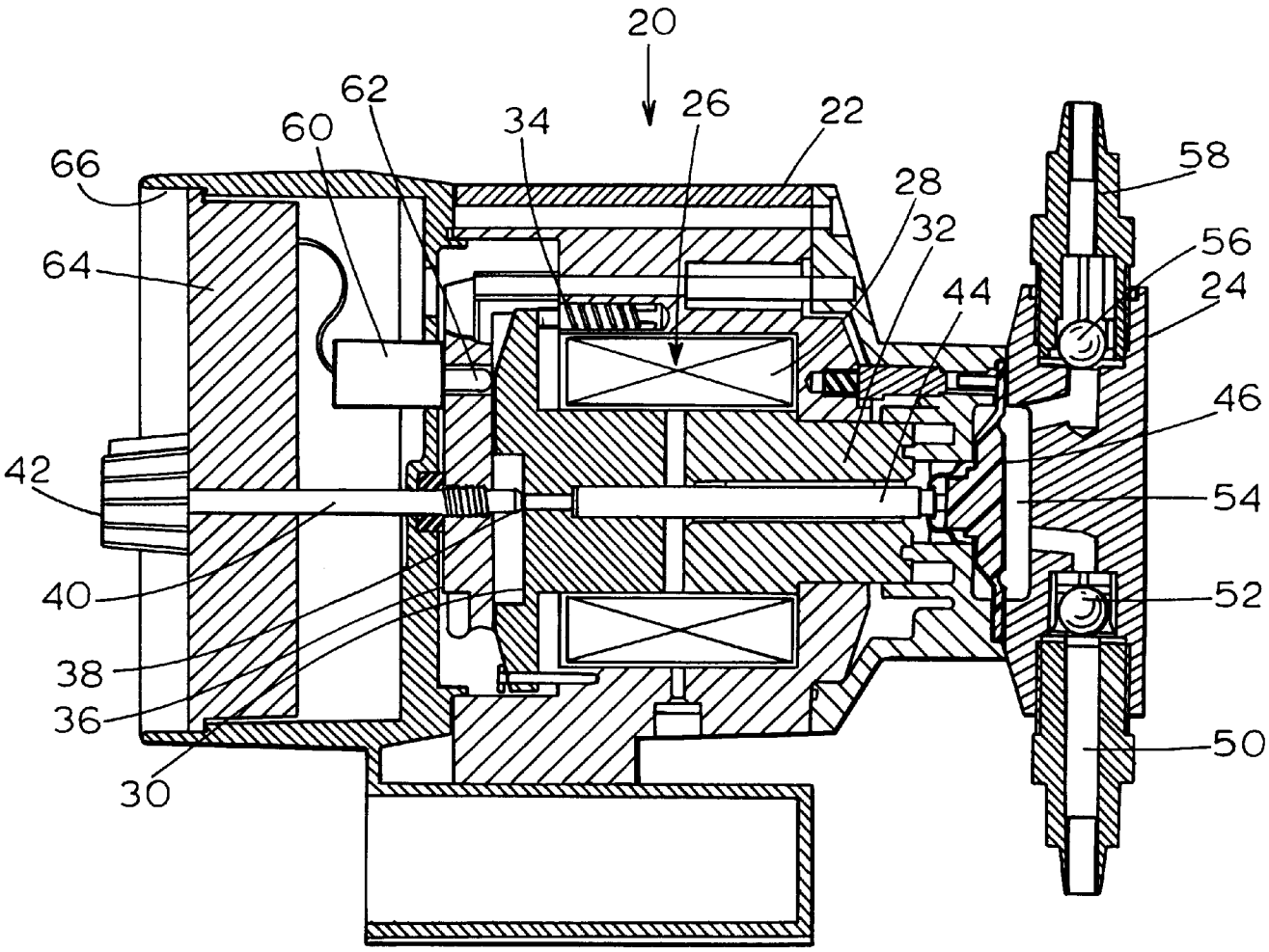
FIGS. 5 and 6 are sectional views of an electromagnetic metering pump that may be controlled according to the present invention.
Figure 6:
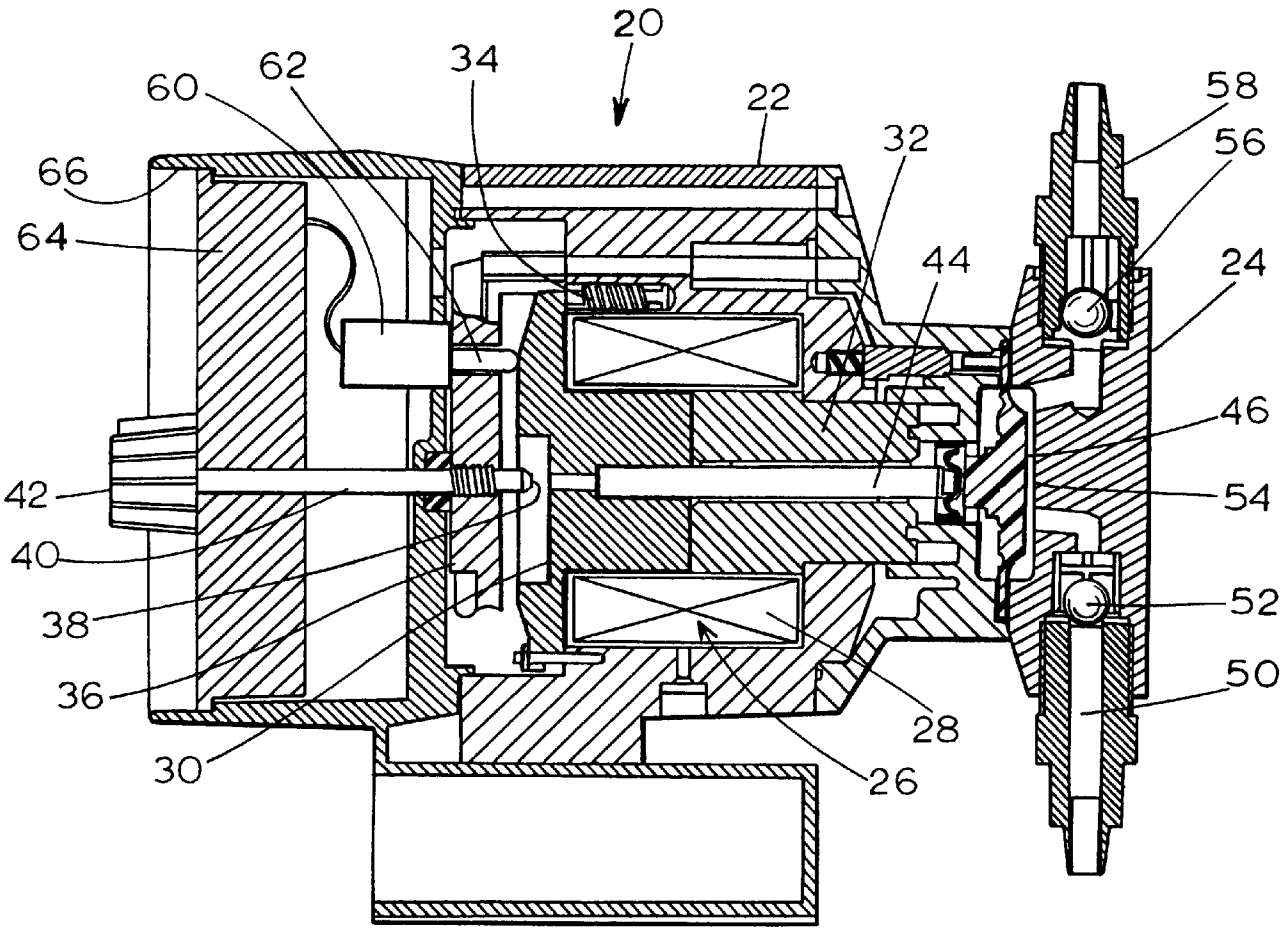
Figure 14A:
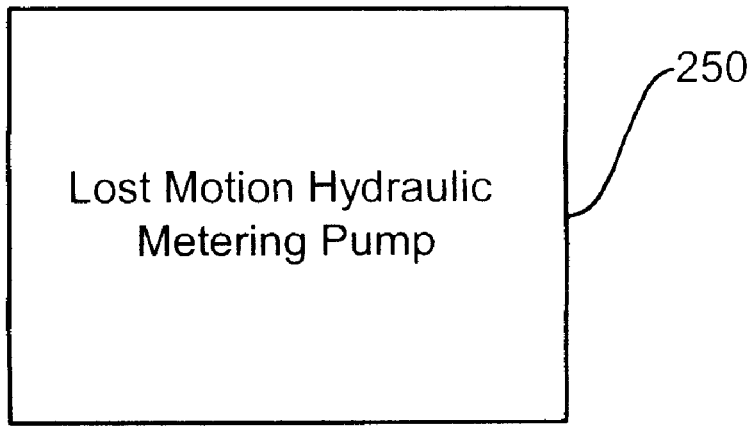
FIGS. 14A and 14B are block diagrams of a lost motion hydraulic metering pump and a variable amplitude hydraulic metering pump, respectively, incorporating the present invention.
Figure 14B:
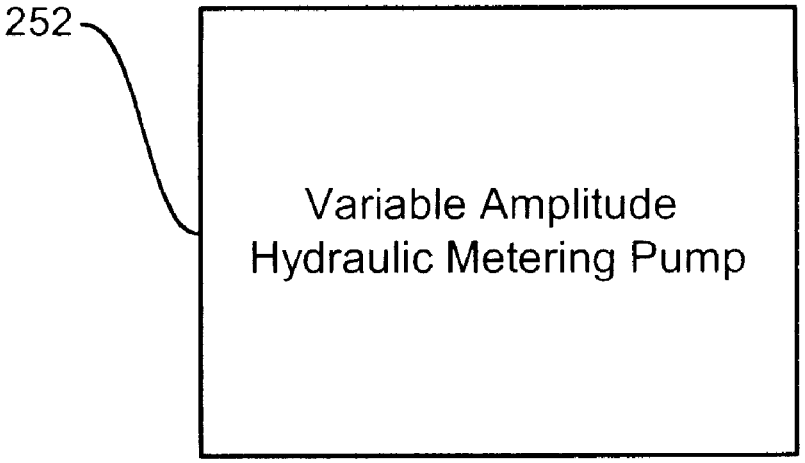

Referring now to FIGS. 5 and 6, there is illustrated an electromagnetic metering pump 20 which may incorporate the present invention. As seen in FIGS. 14A and 14B, it should be noted that the present invention is useful with other types of pumps, such as to control a diaphragm of a lost motion hydraulic metering pump, a variable amplitude hydraulic metering pump or any other pumping apparatus. Referring again to FIGS. 5 and 6, the metering pump 20 includes a main body 22 joined to a liquid end 24. The main body 22 houses an electromagnetic power unit (EPU) 26 that comprises a coil 28 and a movable armature 30. The EPU 26 further includes a pole piece 32 which, together with the coil 28 and the armature 30 form a magnetic circuit. The armature 30 is biased to the left (as seen in FIGS. 5 and 6) by at least one, and preferably a plurality of circumferentially spaced return springs 34 such that, when no excitation is provided to the coil 30, the 30 rests either against a stroke bracket 36 and/or an end 38 of a stroke length adjustment member 40. It should be noted that the armature is preferably balanced in the horizontal position; i.e., the return springs disposed between the 10 o'clock and 2 o'clock positions (when viewed from the side relative to the position shown in FIG. 6) exert lesser biasing forces than the return springs disposed between the 4 o'clock and 8 o'clock positions. This arrangement results in less wear of the bearings supporting the armature and less slip-stick so that less current is required to move the armature within the desired operational constraints.

The position of the end 38 of the member 40 can be adjusted by turning a stroke length adjustment knob 42 to thread the member 40 through the stroke bracket 36, and thereby advance or retract the end 38 toward or away from the pole piece 32.

A shaft 44 is coupled to and moves with the armature 30. The shaft 44 is in turn coupled to a pump diaphragm 46 which is sealingly engaged between the main body 22 and the liquid end 24. As the coil 28 is energized and deenergized, the armature 30, the shaft 40 and the diaphragm 46 are reciprocated between the positions shown in FIGS. 5 and 6. During such reciprocation, liquid is drawn upwardly through a first fitting 50 past a first check valve 52 and enters a diaphragm recess 54. The liquid then continues to travel upwardly past a further check valve 56 and a fitting 58 and outwardly of the pump 20.

A position sensor 60 is provided having a shaft 62 in contact with the armature 30 and develops a signal representative of the position of the armature 30. If desired, the position sensor 60 may be replaced by one or more transducers which develop signals representing the differential between the pressure encountered by the diaphragm 46 and the fluid pressure at the point of liquid injection from the pump. In this case, the power supplied to the coil 28 is controlled so that this pressure difference is kept low but will still finish the discharge stroke within a desired length of time.

Figure 9:
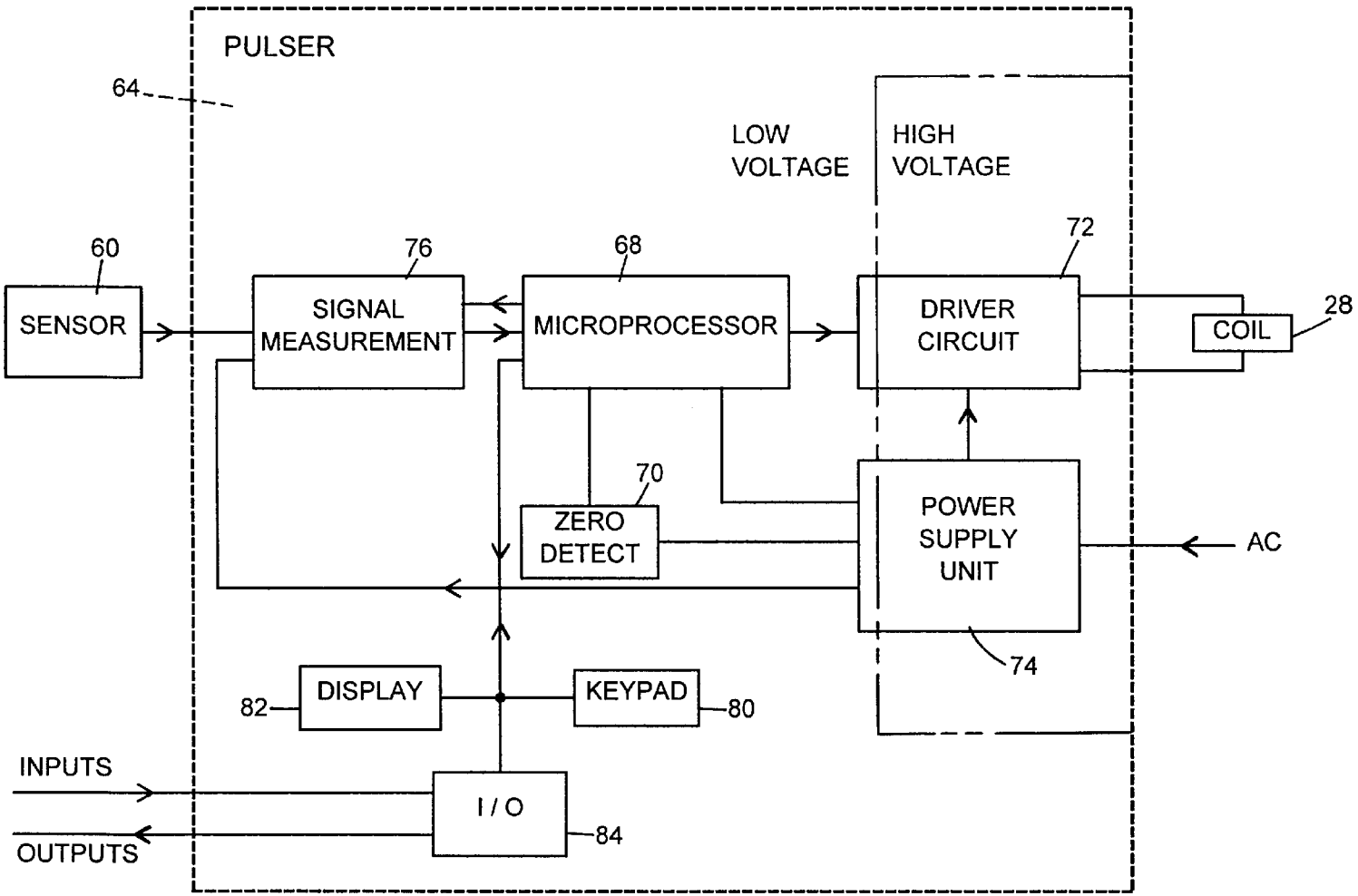
FIG. 9 is a block diagram of a pump control according to the present invention.
Figure 13:
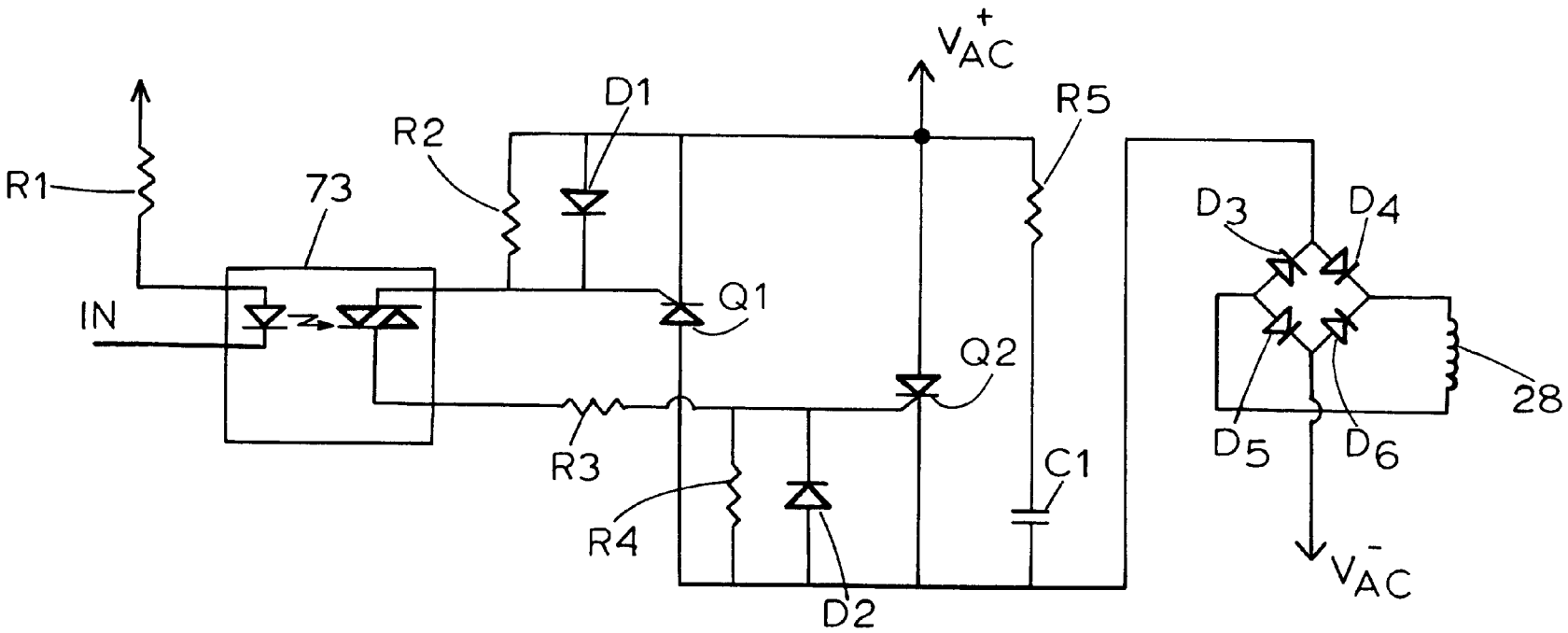
FIG. 13 is a schematic diagram of the driver circuit of FIG. 9.

A pulser circuit 64 is provided in a recess 66. As seen in FIG. 9, the pulser comprises a number of circuit components including a microprocessor 68 which is responsive to a zero detection circuit 70 and which develops signals for controlling a driver circuit 72 shown in greater detail in FIG. 13. In the preferred embodiment, the microprocessor 68 develops control signals which are supplied via an input IN of an opto-isolator 73 to cross-connected switching elements, such as SCR's Q1 and Q2 or other devices such as IGBT's, power MOSFET's or the like. Resistors R1–R5, diodes D1 and D2 and capacitor C1 provide proper biasing and filtering as needed. The SCR's Q1 and Q2 provide phase controlled power which is rectified by the full wave rectifier comprising diodes D3–D6 and supplied to the coil 28. If desired, the microprocessor 68 may instead control the driver circuit 72 to supply pulse width modulated power or true variable DC power to the coil 28.

Figure 7:
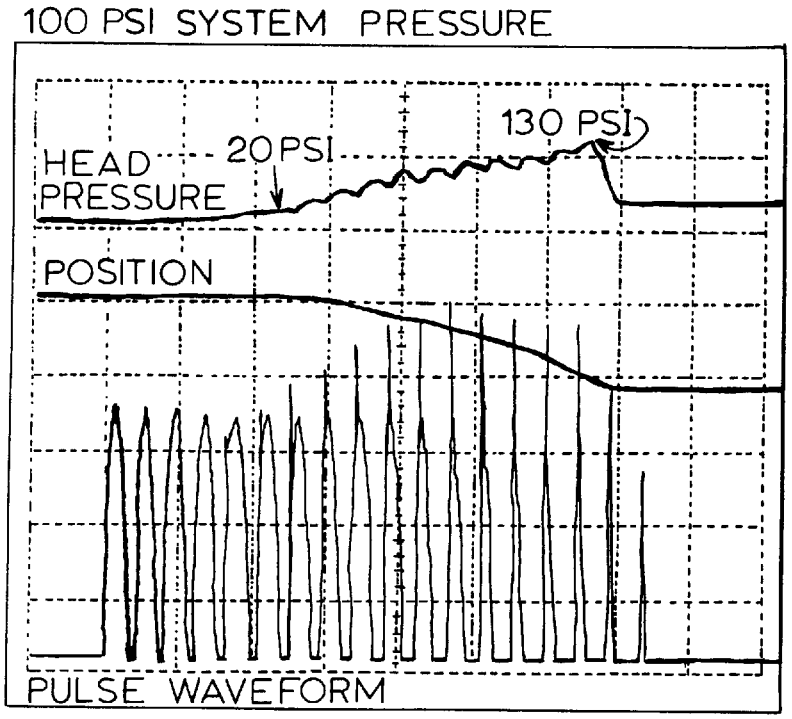
FIGS. 7 and 8 are waveform diagrams illustrating head pressure, armature position and applied pulse waveform at 100 psi and 40 psi system pressure, respectively, for the pump illustrated in FIGS. 5 and 6.
Figure 8:
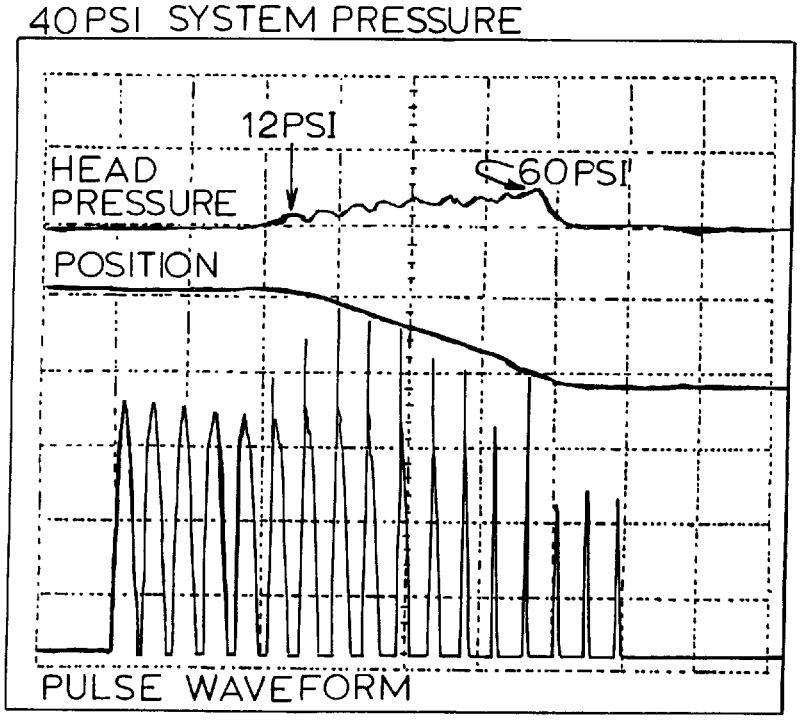
Figure 11:
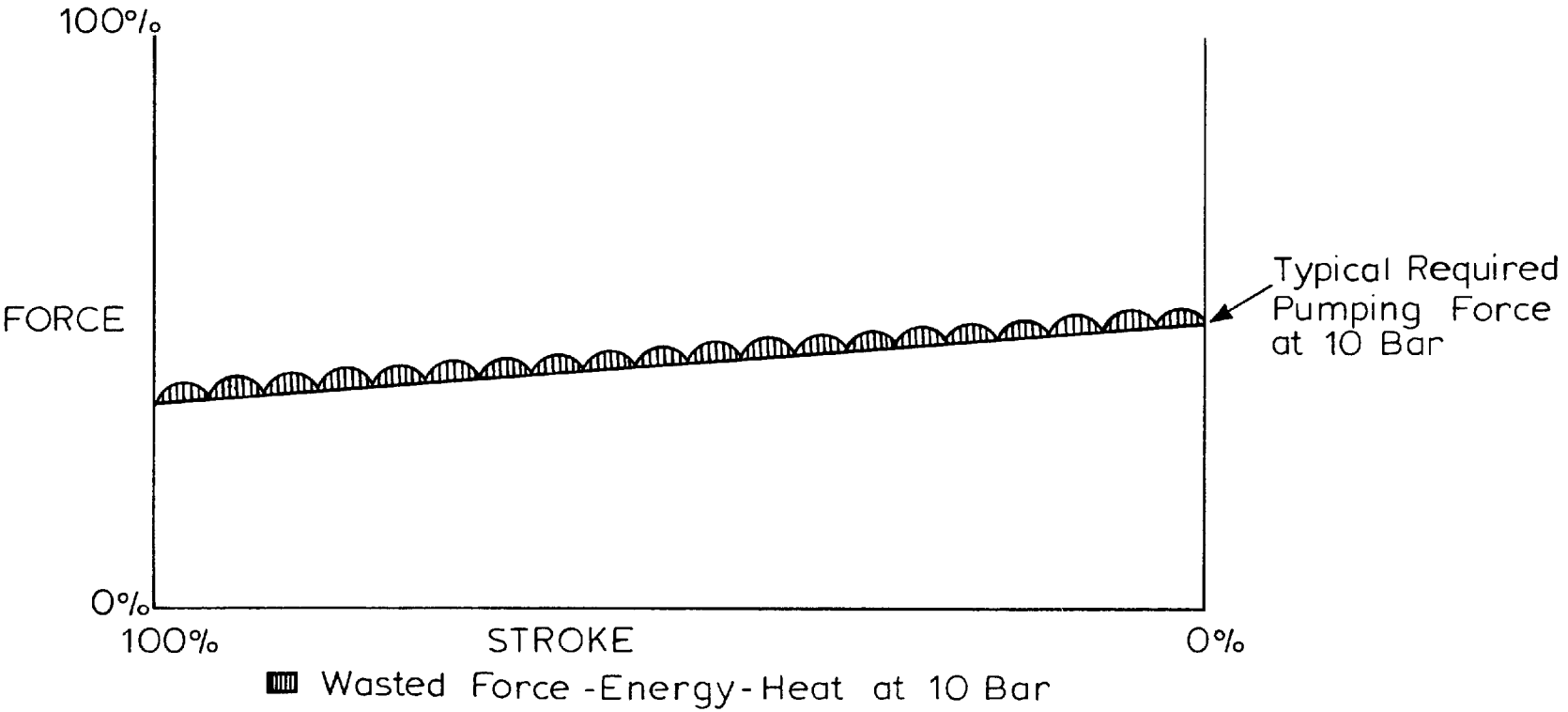
FIGS. 11 and 12 are idealized graphs similar to FIGS. 1–4 illustrating armature force as a function of armature position for the pump of FIGS. 5 and 6.
Figure 12:
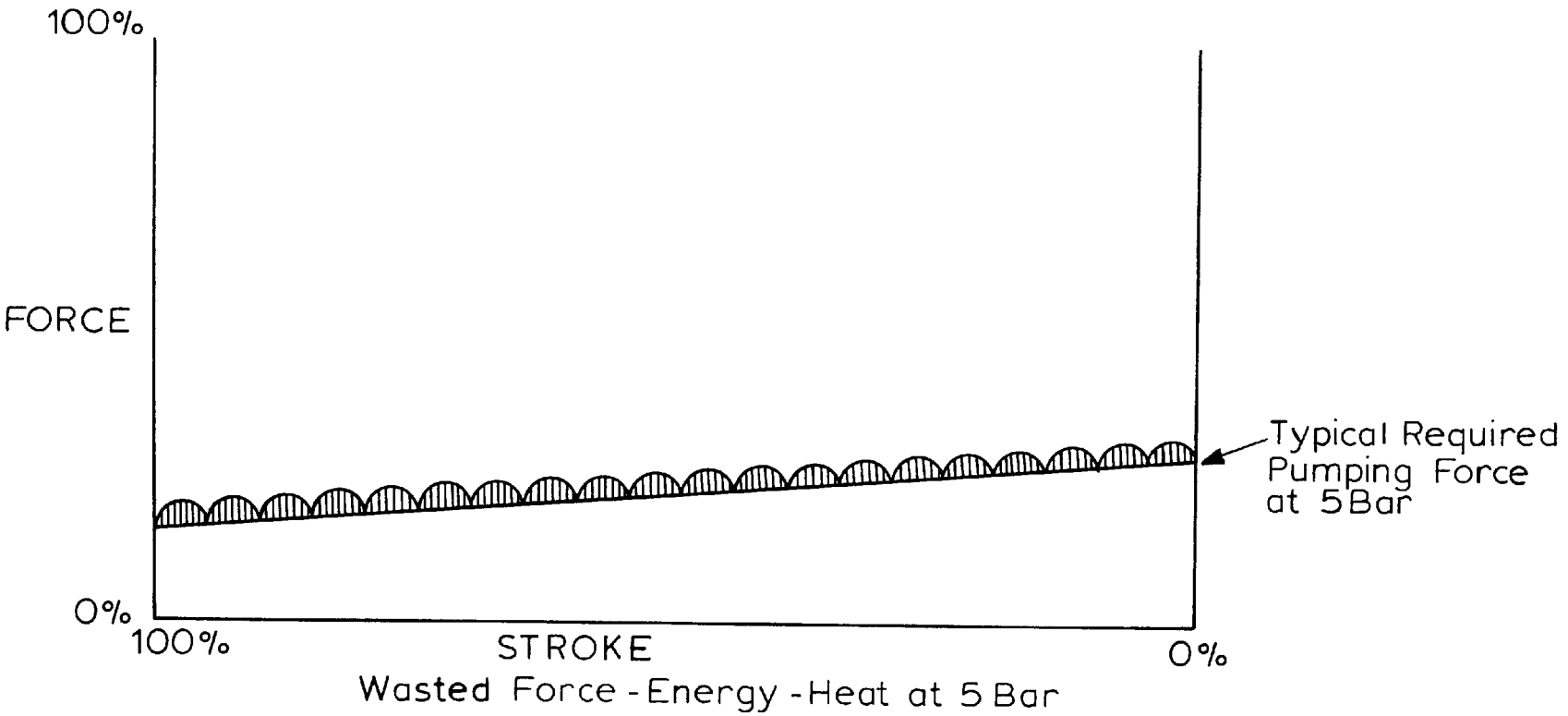

FIGS. 7 and 8 illustrate the operation of the present invention at 100 psi system pressure and 40 psi system pressure, respectively (the system pressure is the liquid pressure at the point of injection of a liquid delivered by the pump 20 into a conduit containing a further pressurized liquid). As illustrated by each of the waveform diagrams of FIGS. 7 and 8, half-wave rectified pulses are appropriately phase controlled (i.e., either a full half-wave cycle or a controllably adjustable portion of a half-wave cycle) and are applied to the coil 28 as a function of position and speed of the armature 30 (as detected by the sensor 60) so that only enough power is supplied to the coil 28 to move the armature 30 the entire stroke length (as determined by the position of the adjustment knob 42 of FIGS. 5 and 6) without wasting significant amounts of force of energy and generating significant amounts of heat. In the waveform diagrams of FIG. 7, the head pressure (i.e, the pressure to which the diaphragm 46 is exposed) varies between 30 psi and 130 psi during movement of the armature 30 (and thus the diaphragm 46) between the position shown in FIG. 5 and the position shown in FIG. 6. In the case of the waveform diagrams of FIG. 8, the head pressure varies between 12 psi and 60 psi as the armature 30 moves over the stroke length. In both cases, half-wave rectified sinusoidal pulses are initially applied to the coil 28 wherein the pulses are phase controlled to obtain pulse widths that result in a condition just short of or just at saturation of the EPU 26. Thus, the armature 30 is accelerated as quickly as possible without significant heat generation and dissipation. Thereafter, narrower pulses are applied as the armature 30 moves toward its travel limit. FIGS. 11 and 12 illustrate the tracking of developed EPU force with system pressure as a function of armature position for the pump of FIGS. 5 and 6. It can be seen that relatively little power is wasted, and hence, noise is reduced (because the armature does not slam into the pole piece 32 at the end of the stroke) as are generated heat levels.

Referring again to FIG. 9, the EPU driver receives the AC power from a power supply unit 74, which also supplies power to the microprocessor 68 and a signal measurement interface circuit 76 that receives an output signal developed by the position sensor 60. The zero detect circuit 70 detects zero crossings in the AC waveforms and provides an interrupt signal to the microprocessor 68 for purposes hereinafter described.

Figure 10A:
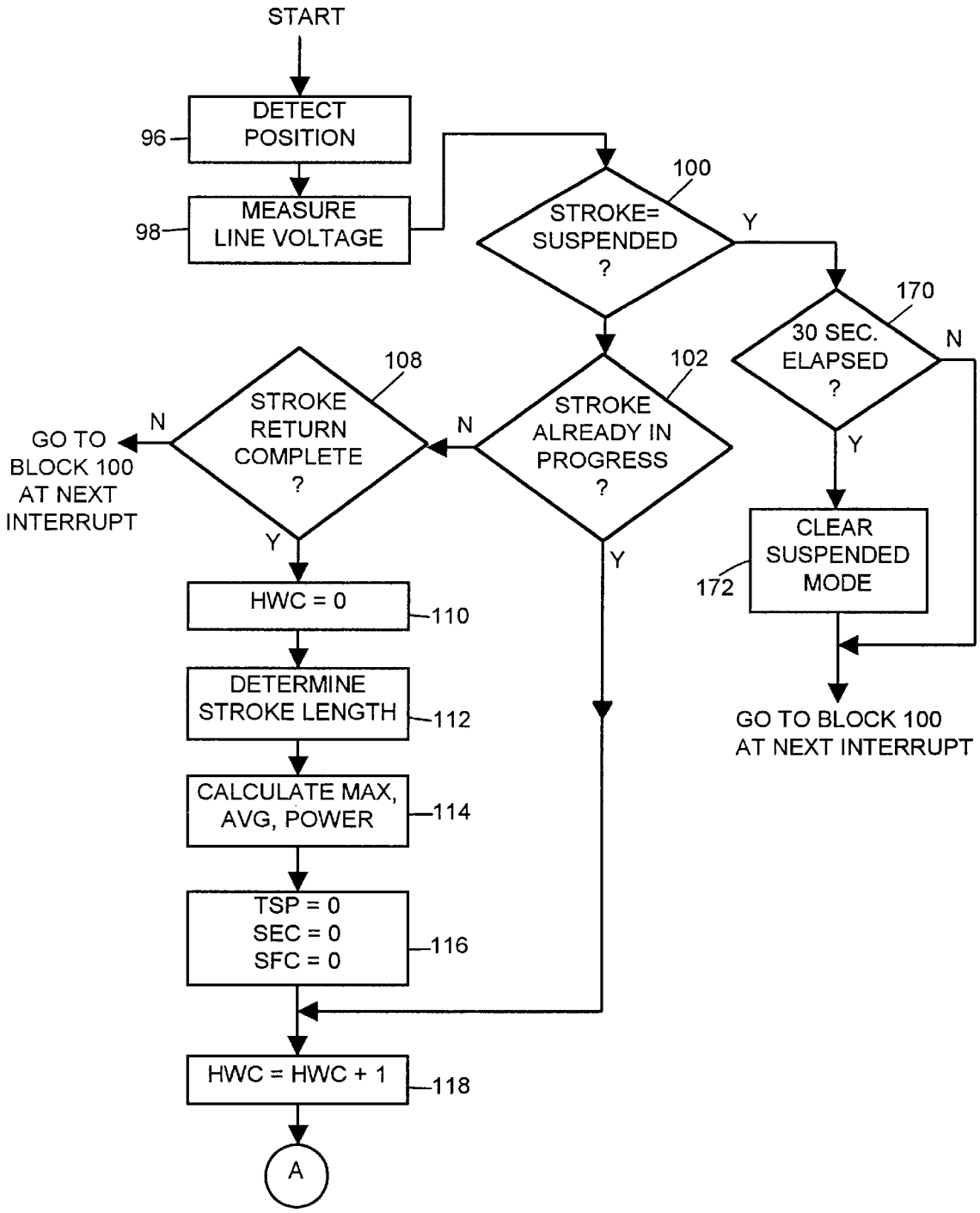
FIGS. 10A–10C, when joined along the similarly lettered lines, together comprise a flowchart of programming executed by the microprocessor of FIG. 9 to implement the present invention.
Figure 10B:
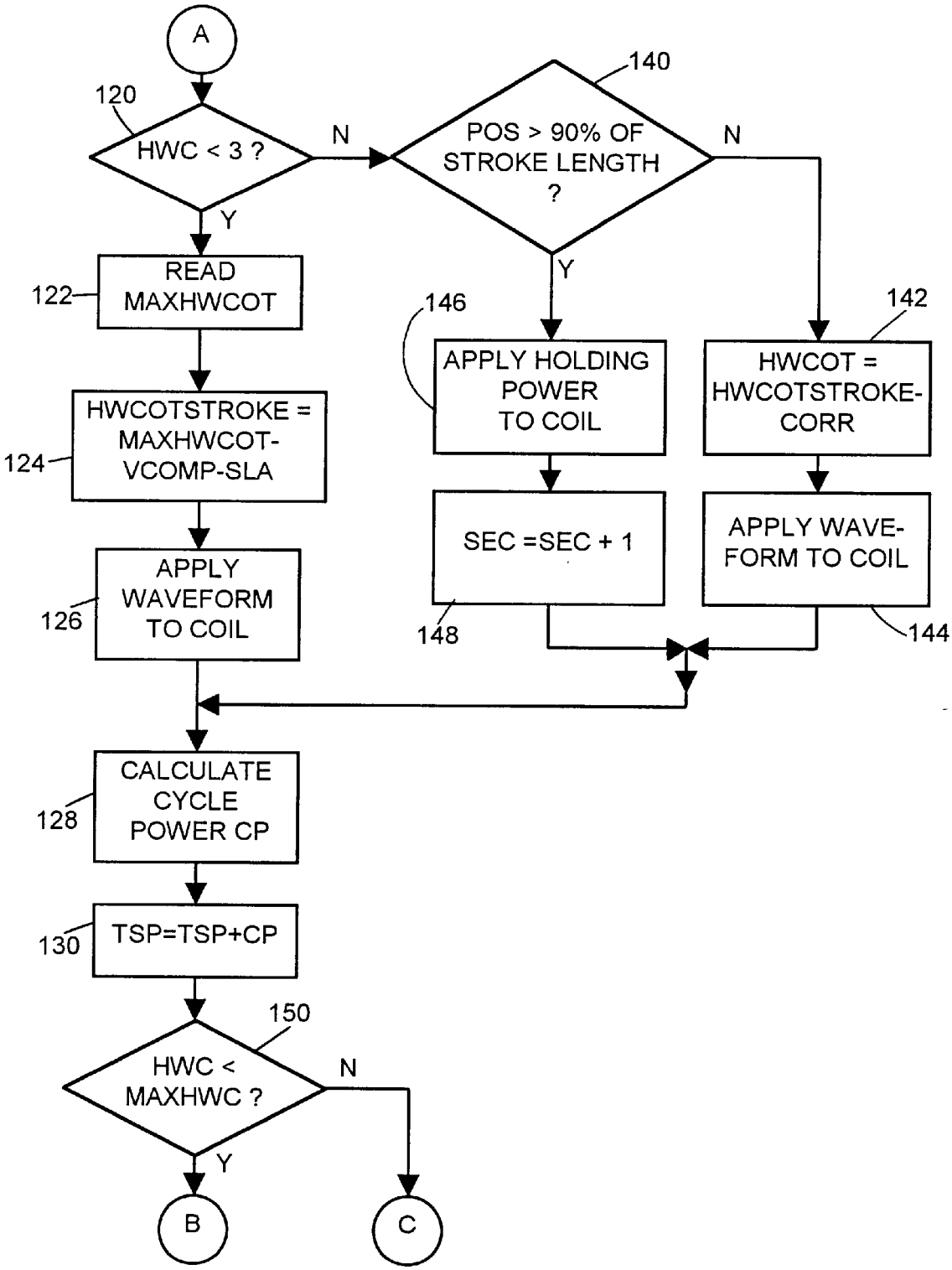
Figure 10C:
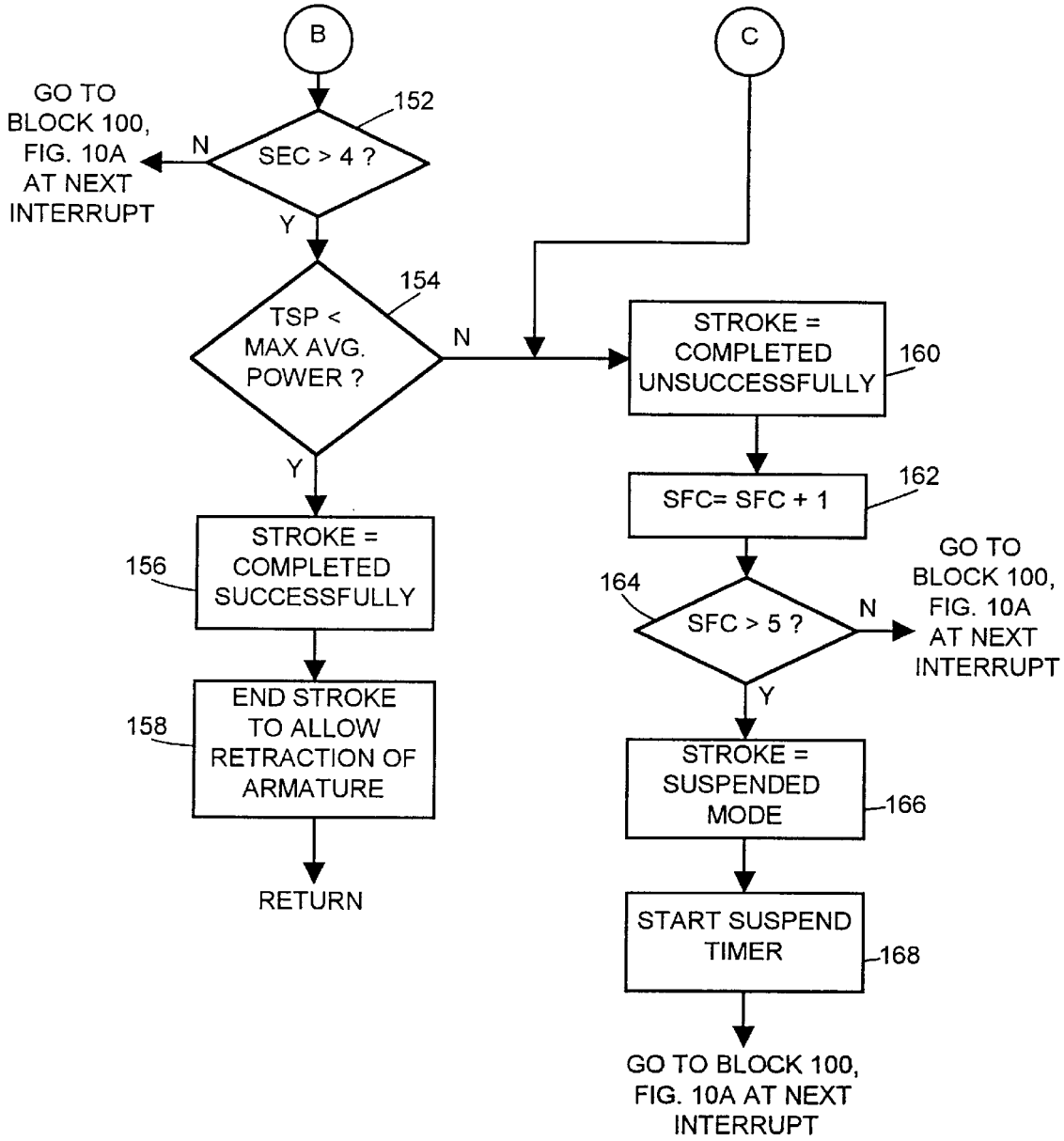

In addition to the foregoing, the microprocessor may be coupled to a keypad 80 and a display 82, as well as other input/output (I/O) circuits 84 as desired or required. The microprocessor 68 (not shown) is suitably programmed to execute a control routine, a portion of which is illustrated in FIGS. 10A–10C. The software of FIGS. 10A–10C is operable in response to interrupts provided to the microprocessor 68 by the power supply unit 74 to synchronize the operation of the microprocessor 68 to the pulses delivered to the EPU driver 72. The balance of the software executed by the microprocessor 68 (not shown) determines when the software illustrated in FIGS. 10A–10C should be executed. This decision may be made in response to an initiation signal developed by a user or by apparatus which is responsive to some operational parameter of a process or in response to any other signal.

Referring first to FIG. 10A, once the microprocessor 68 determines that the software illustrated by FIGS. 10A–10C is to be executed, a block 96 checks the output of the signal measurement circuit 76 to detect the position of the armature 30. A block 98 then operates the signal measurement interface circuit 76 to sense the magnitude of the AC voltage supplied by the power supply unit 74. Thereafter, a block 100 checks to determine whether a flag internal to the microprocessor 68 has been set indicating that pumping has been suspended. If this is not the case, a block 102 checks to determine whether a stroke of the armature 30 is already in progress. If this is not true, a block 108 checks to determine whether the armature 30 has returned to its rest position under the influence of the return springs 34. This is determined by checking the output of the position sensor 60 and the signal measurement circuit 76. If this is not the case, control returns to the block 100 when the next interrupt is received. Otherwise, control passes to a block 110, which initializes a variable HWC (denoting half wave cycle number) to a value of zero.

Following the block 110, a block 112 determines the length of the stroke to be effected as determined by the setting of the stroke length adjustment knob 42. Based upon stroke length and stroke rate, a block 114 calculates a maximum average power level APMAX which is not to be exceeded during the stroke as follows:

$$APMAX=CPMAX*SPMMAX*SLAMAX/SPM*SLA$$

where CPMAX is a stored empirically-determined value representing the maximum continuous power allowed at maximum stroke length (SLAMAX), maximum stroke rate (SPMMAX) and maximum pressure. (SLAMAX and SPMMAX are stored as well.) SPM is the actual stroke rate which may be determined and input by a user or which may be a parameter set by an external device. SLA is the stroke length as determined by the block 112.

The value of APMAX represents the maximum power to be applied to the coil 28 beyond which no further useful work will result (in fact, a deterioration in performance and heating will occur). Following the block 114, a block 116 initializes variables TSP (denoting total stroke power), SEC (a stroke end counter which is incremented at the end of the stroke) and SFC (a stroke fail counter which is incremented at the end of a failed stroke) to zero.

Following the block 116, and following the block 102 if it has been determined that a stroke is already in progress, a block 118 increments the value of HWC by one and control passes to a block 120, FIG. 10B. The block 120 checks to determine whether the value of HWC is less than or equal to three. If this is found to be true, control passes to a block 122 which reads a value MAXHWCOT stored in the microprocessor 68 and representing the maximum half wave cycle on time (i.e., the maximum half wave pulse width or duration). This value is dependent upon the frequency of the AC power supplied to the power supply unit 74.

A block 124 then establishes the value of a variable HWCOTSTROKE (denoting half wave cycle on time for this stroke) at a value equal to MAXHWCOT less a voltage compensation term VCOMP and less a stroke length adjustment term SLA. It should be noted that either or both of VCOMP and SLA may be calculated or determined in accordance with empirically-derived data and/or may be dependent upon a parameter. For example, each of a number of positive and/or negative empirically-determined values of VCOMP may be stored in a look-up table at an address dependent upon the value of the AC line voltage magnitude as sensed by the block 98 of FIG. 10A. The term SLA may be determined in accordance with the stroke length as set by the stroke length adjustment knob 42. Specifically, each of a number of empirically-determined values of SLA may be stored in a look-up table at an address dependent upon the stroke length determined by the block 112. Following the block 124, a block 126 then operates the EPU driver circuit 72 so that a half-wave rectified pulse of duration determined by the current value of HWCOTSTROKE is applied to the coil 28.

Thereafter, a block 128 calculates the total power applied to the coil 28 by the block 126 and a block 130 accumulates a value TSP representing the total power applied to the coil 28 over the entire stroke. The value TSP is equal to the accumulated power of the previous pulses applied to the coil 28 during the current stroke as well as the power applied by the block 126 in the current pass through the programming.

If the block 120 determines that the value of HWC is greater than 3, a block 140 checks to determine whether the position of the armature 30 is greater than 90% of the total stroke length (in other words, the block 140 checks to determine whether the armature 30 is within 10% of its end of travel). If this is not true, the value HWCOT is calculated by a block 142 as follows:

$$HWCOT=HWCOTSTROKE-CORR$$

Each of a number of values for the term CORR in the above equation may be stored in a look-up table at an address dependent upon the distance traveled by the armature 30 since the last cycle, the current position of the armature 30 as well as the current value of HWC (i.e., the number of half-waves that have been applied to the coil 28 during the current stroke). The function of the block 142 is to reduce the power applied during each cycle as the stroke progresses. Thereafter, a block 144 operates the driver 72 to apply a half-wave rectified pulse, appropriately phase controlled in accordance with the value of HWCOT, to the coil 28. Following the block 144, control passes to the block 128.

If the block 140 determines that the position of the armature 30 is within 10% of the stroke length, a block 146 controls the EPU driver 72 to apply a voltage to the coil 28 sufficient to hold the coil at its end of travel. Preferably, this value is selected to provide just enough holding force to keep armature 30 at the end of travel limit but is not so high as to result in a significant amount of wasted power. Following the block 146, a block 148 increments the stroke end counter SEC by one and control passes to the block 128.

Once the current cycle power and the total stroke power have been calculated by the blocks 128 and 130, a block 150 checks to determine whether the value of HWC is less than or equal to a maximum half-wave cycle value MAXHWC stored by the microprocessor 68. If this is true, control passes to a block 152, FIG. 10C, which checks to determine whether the current value stored in the stroke end counter SEC is greater than or equal to 4. If this is not true, control passes back to the block 100 of FIG. 10A upon receipt of the next interrupt. On the other hand, if SEC is greater than or equal to 4, control passes to a block 154 which checks to determine whether the current calculated total stroke power TSP is less than or equal to the maximum average power calculated by the block 114 of FIG. 10A. If this is also true, a flag is set by a block 156 indicating that the current stroke has been completed successfully. A block 158 then removes power from the coil 28 so that the armature 30 can be returned under the influence of the return springs 34 to the retracted position in abutment with either or both of the stroke bracket 36 and the end 38 of the stroke length adjustment member 40.

If the block 154 determines that the total stroke power exceeds the value of the maximum average power calculated by the block 114, a flag is set by a block 160 indicating that the current stroke has been completed unsuccessfully and a block 162 increments the stroke fail counter by 1. Thereafter, a block 164 checks to determine whether the stroke fail counter SFC has a current value greater than 5. If this is true, a flag is set indicating that the current stroke has been placed in the suspended mode by a block 166 and a block 168 starts a timer which is operable to maintain the suspended mode flag for a certain period of time, such as 30 seconds. Control then returns at receipt of the next interrupt to the block 100, FIG. 10A, following which a block 170 checks to determine whether the 30 second timer has expired. Once this occurs, a block 172 clears or resets the suspended mode flag.

Following the block 172, or following the block 170 if the 30 second timer has not expired, control returns to the block 100 upon receipt of the next interrupt.

If the block 164 determines that the current value of the stroke fail counter SFC is not greater than 5, control passes at receipt of the next interrupt to the block 100 of FIG. 10A.

As should be evident, the effect of the foregoing programming is initially to apply three half-wave rectified pulses phase controlled in accordance with the value of VCOMP and SLA to the coil 28 and thereafter apply half-wave rectified pulses which have been phase controlled in accordance with the equation implemented by the block 142 of FIG. 10B until the 90% stroke length limit is rendered. In general, the pulse widths are decreased during this interval until the 90% point is reached and thereafter the holding power is applied to the coil 28. As pulses are applied to the coil 28, the power applied to the coil during the stroke is accumulated and, if the power level exceeds the maximum average power level, a conclusion is made that the stroke has been completed unsuccessfully. If five or more strokes are unsuccessfully completed, further operation of the pump 20 is suspended for 30 seconds.

The present invention obtains important advantages over other pumps:

1. The present pump control results in less pressure pulsation as well as lower peak pressure. These factors contribute to accuracy because there is substantially no excess energy that results in overpumping.

2. The pump is quieter than comparable conventional electromagnetic pumps because of less banging by the armature 30 at the end of the stroke owing to the reduction in power as the armature 30 is about to contact the pole piece 32. Accuracy is also improved because there is less fluid inertia at the end of the discharge stroke which otherwise could result in overpumping, especially under certain circumstances.

3. The present control methodology results in a longer pump life owing to the reduction in stress on the various components. Accuracy is also improved because the stroke length will have a lesser tendency to grow with time. In addition, heat, and hence thermal expansion, are reduced and return springs can be made less stiff, thereby resulting in lesser stresses.

4. The pump utilizes less power than other pumps of comparable rating.

5. A pump incorporating the present invention can pump more viscous materials when the material is at a pressure less than full pressure rating. The software automatically detects a high viscous fluid condition owing to the detection of armature position with respect to time and adds up to 50% more power to force the viscous fluid through the liquid end 24. This also contributes to accuracy owing to the ability to complete the stroke even if the chemical becomes viscous only temporarily.

6. The present pump has the ability to develop full pumping power even when used at a voltage less than rated. At less than rated voltage, the software detects the slowed armature movement and adds more power to insure that the stroke is completed.

7. A pump incorporating the present invention can be used at higher than rated voltage without overheating owing to the ability to phase back (i.e., reduce) the power applied to the coil as required. This also means that a pump incorporating the present invention does not require different coils for different voltage ratings.

8. The present pump can implement automatic pressure control, thereby obviating the need for a pressure adjustment screw or other pressure adjustment device.

9. The present pump can be used in a wider range of applications due to the ability to interface with a greater number of different devices.

10. A pump utilizing the present invention is externally programmable in the sense that pumping characteristics can be changed by changing the programming of the microprocessor 68.

As noted previously in connection with FIGS. 14A and 14B, the present invention is not limited to use with an electromagnetic metering pump. The present control could instead be used to operate a control element of a lost motion hydraulic metering pump 250 or a variable amplitude hydraulic metering pump 252, or any other suitable device, as desired.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A control for a pump having a pump element movable over an entire stroke length, comprising:

a sensor for detecting an operational characteristic of the pump; and means responsive to the sensor for causing the pump element to move the entire stroke length within a desired length of time.

2. The control of claim 1, wherein the sensor comprises a position sensor which senses pump element position.

3. The control of claim 1, wherein the pump element comprises a coil and an armature.

4. The control of claim 3, wherein the causing means includes means for modulating electrical power delivered to the coil.

5. The control of claim 4, wherein the pump element travels at a velocity and the modulating means is responsive to the pump element velocity.

6. The control of claim 1, wherein the sensor comprises at least one pressure transducer which senses a pressure differential.

7. The control of claim 1, wherein the pump comprises an electromagnetic metering pump.

8. The control of claim 1, wherein the pump comprises a lost motion hydraulic metering pump.

9. The control of claim 1, wherein the pump comprises a variable amplitude hydraulic metering pump.

10. A control for an electromagnetic metering pump having a coil, an armature movable over a stroke length and a diaphragm coupled to the movable armature, comprising:

a position sensor for detecting armature position on a continuous basis over the stroke length;

a driver circuit coupled to the coil and supplying electrical power thereto; and means coupled between the position sensor and the driver circuit for controlling the driver circuit such that electrical power is delivered to the coil in dependence upon the armature position.

11. The control of claim 10, wherein the controlling means comprises a programmed processor.

12. The control of claim 10, wherein the controlling means comprises a phase controller.

13. The control of claim 10, wherein the controlling means comprises a pulse-width modulator.

14. The control of claim 10, wherein the controlling means comprises a means for varying DC power delivered to the coil.

15. A control for an electromagnetic metering pump having a coil, an armature movable over a stroke length and a diaphragm coupled to the movable armature, comprising:

a sensor for continuously detecting armature position over a stroke length;

a driver circuit coupled to the coil and delivering electrical power thereto; and a programmed processor responsive to the sensor and controlling the driver circuit such that electrical power is delivered to the coil in dependence upon the position of the armature.

16. The control of claim 15, wherein the processor comprises means for modulating electrical power delivery to the coil in dependence upon the position of the armature.

17. The control of claim 16, wherein the modulating means comprises a phase controller.

18. The control of claim 16, wherein the modulating means comprises a pulse-width modulator.

19. The control of claim 15, wherein the processor comprises means for varying DC power delivered to the coil.

20. A method of controlling a pump having a coil, an armature movable over a range of positions comprising an entire stroke length and a pumping element coupled to the armature, the method comprising the steps of:

detecting the position of the armature over the entire stroke length; and providing electric power to the coil based on the position of the armature.

* * * * *